US005890332A

United States Patent [19]

Skidmore et al.

[11] Patent Number: 5,890,332

[45] Date of Patent: Apr. 6, 1999

[54] RECONSTITUTED WOOD BLOCK MODULAR BUILDING SYSTEM

[76] Inventors: Lester J. Skidmore, 110 Oak Creek Cir., Prattville, Ala. 36067; Paul J. Latino, 1116 Townhouse Rd., Helena, Ala. 35080

[21] Appl. No.: 785,656

[22] Filed: Jan. 17, 1997

[51] Int. Cl.[6] ..... E04B 2/18

[52] U.S. Cl. ..... 52/271; 52/274; 52/285.1; 52/295; 52/586.1

[58] Field of Search ..... 52/586.1, 586.2, 52/566, 567, 270, 271, 284, 295, 223.7, 223.3, 274, 285.1

[56] References Cited

U.S. PATENT DOCUMENTS

| | | | |
|---|---|---|---|
| 2,392,551 | 1/1946 | Roe | 52/586.2 |
| 2,627,176 | 2/1953 | Levy | 62/223.7 |
| 4,195,019 | 3/1980 | Babina et al. . | |
| 4,726,567 | 2/1988 | Greenberg | 52/223.7 |
| 5,246,652 | 9/1993 | Hsu et al. . | |
| 5,365,714 | 11/1994 | Potvin . | |
| 5,439,749 | 8/1995 | Klasell et al. . | |

FOREIGN PATENT DOCUMENTS

| | | | |
|---|---|---|---|
| 484750 | 5/1938 | United Kingdom | 52/586.2 |
| 1332297 | 10/1973 | United Kingdom | 52/586.2 |

*Primary Examiner*—Michael Safavi
*Attorney, Agent, or Firm*—Richard L. Miller, P. E.

[57] ABSTRACT

A reconstituted wood block modular building system utilized to build at least a wall that includes a concrete slap, a plurality of anchor bolts, a plurality of vertically-oriented steel rods, a plurality of threaded sleeves, a plurality of reconstituted wood blocks, a plurality of elongated, slender, and rectangular-parallelepiped-shaped horizontal alignment keys, a plurality of elongated, slender, and rectangular-parallelepiped-shaped vertical alignment keys, and an adhesive. The plurality of reconstituted wood blocks are positioned horizontally side by side and are stacked vertically without being staggered. Each block has a cylindrically-shaped throughbore that opens into, and extends vertically downwardly from, a center of the flat top face thereof to, and opens into, a center of the flat bottom face thereof, and communicates with both the top face longitudinal groove and the bottom face longitudinal groove, and provides a conduit for electrical wiring and plumbing and thereby eliminates a need for drilling and cutting. The cylindrically-shaped throughbore in vertically aligned blocks vertically receives the plurality of vertically-oriented steel rods so as to provide added strength for the wall to withstand most winds and hurricanes. Each horizontal alignment key is disposed in the end face groove of adjoining end faces of horizontally adjacent blocks. Each vertical alignment key is disposed in the top face longitudinal groove in each block, on both sides of the cylindrically-shaped throughbore, and extends horizontally into the top face longitudinal groove in a horizontally adjacent block. Each vertical alignment key is further disposed in the bottom face longitudinal groove in a vertically adjacent block, on both sides of the cylindrically-shaped throughbore, and extends horizontally into the bottom face longitudinal groove in a horizontally adjacent block. And, the adhesive is disposed on, and attaches, adjoining faces of adjacent blocks, without the need for mortar.

17 Claims, 2 Drawing Sheets

FIG. 7
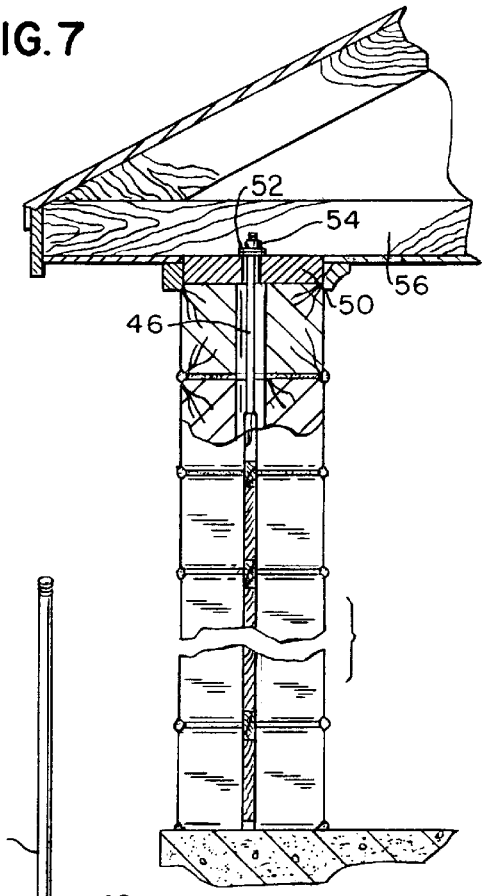
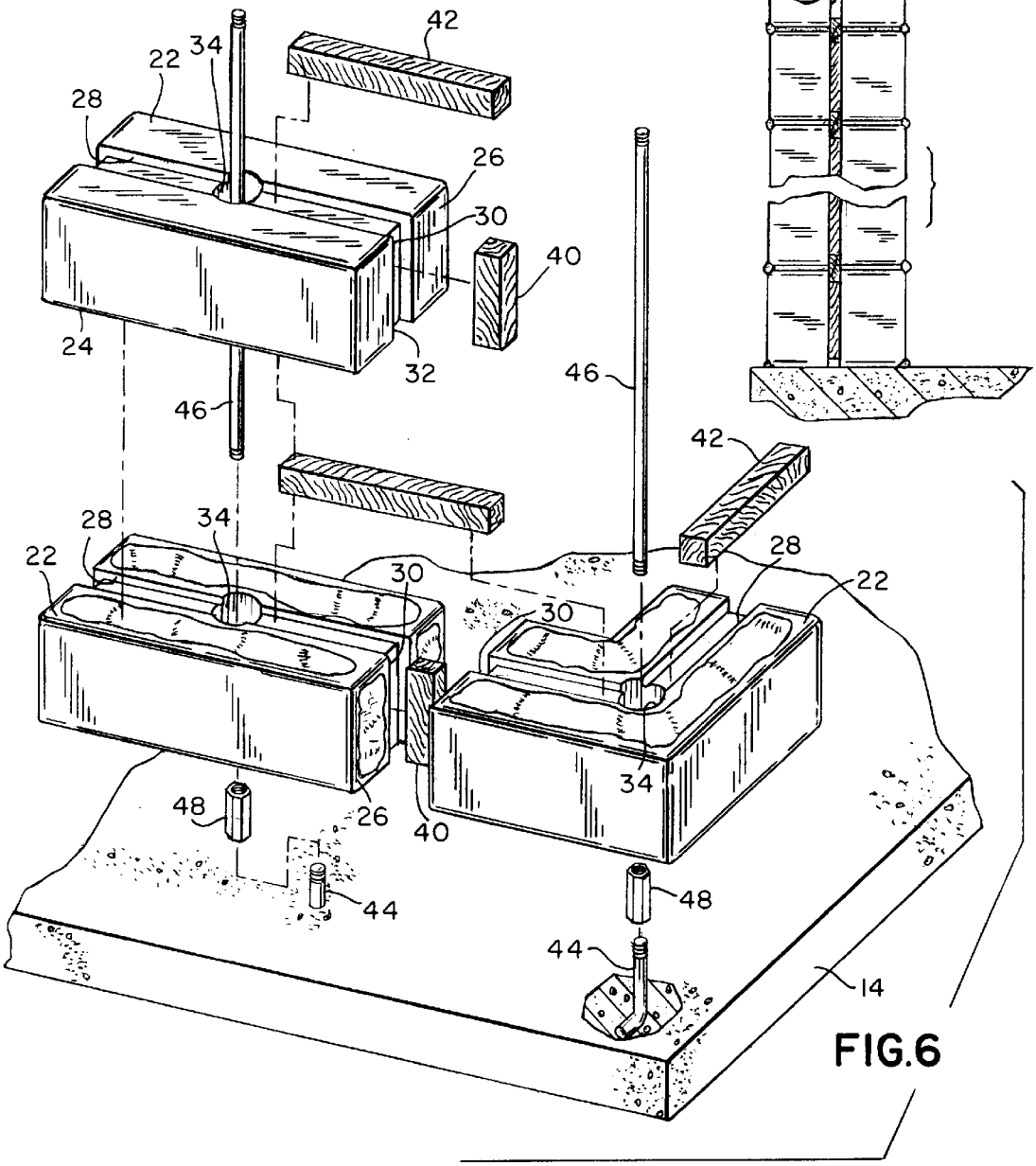
FIG. 6

RECONSTITUTED WOOD BLOCK MODULAR BUILDING SYSTEM

BACKGROUND OF THE INVENTION

The present invention relates to a building system. More particularly, the present invention relates to a reconstituted wood block modular building system.

At present many families are unable to purchase decent affordable housing as a result of high costs, mortgage requirements, and allied expenses. Rents have accelerated to a point where the larger part of meager incomes is consumed for shelter. Consequently, it is most apparent that a definite need exists for a building product that would contain and embrace many of the features now found in conventional wood frames homes, i.e. "stick built," and provide secure and adequate shelter at an affordable price.

There has been many attempts in the past to alleviate the housing situation through the development and refinement of wood frame homes, masonry homes, concrete block homes, log homes, mobile homes, etc., but all have had certain drawbacks. The problems usually were associated with the cost involved, livability, durability, and/or the difficulty encountered with erection.

The construction of homes has changed very little in the last hundred years. New products have been produced, lumber and labor are still the main ingredient. With the virgin wood forest rapidly dwindling away, however, lumber has become very costly. Skilled labor is very expensive Numerous innovations for composite wood structures have been provided in the prior art that will be described. Even though these innovations may be suitable for the specific individual purposes to which they address, however, they differ from the present invention in that they do not teach a reconstituted wood block modular building system.

FOR EXAMPLE, U.S. Pat. No. 4,195,019 to Babina et al. teaches a compression-molding composition containing 95 to 98 parts by weight of a product resulting from the treatment of crushed wood with an aqueous solution of phenol and formaldehyde at the boiling temperature of the solution in the presence of hydrochloric acid at a weight ratio between phenol formaldehyde, water, hydrochloric acid and crushed wood equal to 0.15–0.40:0.048–0.27:10–15:0.07–24–0.1086:1, respectively, 1 to 3 parts by weight of a curing agent, viz, hexamethylenetetramine, 0.5 to 1 part by weight of a curing accelerator such as calcium oxide or magnesium oxide, and 0.5 to 1.0 part by weight of a lubricant such as stearing, oleic acid or stearates. The compression-molding composition has an increased water-resistance (its water-absorption is at most 42–82 mg), a high curing rate (0.57–0.8 min/mm), elevated Martens yield temperature (up to 146 degrees C.) thus making it possible to widen the field of application of the compression-molding composition. A method for preparing the compression-molding composition comprises agitation of the components simultaneously with disintegration thereof at a temperature of 97–99 degrees C. to the content of volatile compounds of from 6 to 10% by weight. The method is simple in implementation, it has a reduced number of technological steps and lowered power- and labor-consumption in the manufacture of a compression-molding composition.

ANOTHER EXAMPLE, U.S. Pat. No. 5,246,652 to Hsu et al. teach a method of producing a wood composite treated with a soluble boron compound. Either a phenol-formaldehyde resole or novolac type resin can be used as the binder for a wood furnish. The wood furnish is surface treated with either the resole type resin or novolac resin together with a water soluble boron compound whereafter the surface treated wood furnish is formed into a mat and then consolidated in a press. When novolac is used as the resin, the consolidation takes place under sufficient pressure, heat and time in order to cure the novolac type resin and to form the wood composite. Optionally, the curing of the novolac resin can be promoted by injecting the compressed mat with steam, rather than by means of heated press platens. If a resole type resin is employed as the binder while in its consolidated condition, however, pressurized steam is injected into the consolidated mat for a time sufficient to cure the binder and form the composite. The wood composite so produced and which contains the soluble boron compound, exhibits acceptable internal bond strength, and as a result of the inclusion of the boron compound, renders the composite less susceptible to biological attack and more fire retardant than conventional composites employing phenol-formaldehyde alone as the thermosetting adhesive.

STILL ANOTHER EXAMPLE, U.S. Pat. No. 5,365,714 to Potvin teaches a wall for a rampart or building, consisting of a plurality of building blocks, each comprising slightly compacted sawdust or wood chips glued with resin. The building blocks are interconnected by a number of assembling pins and by recesses integral to the respective blocks, so as to frictionally engage into one another. There are also provided full length projections and corresponding grooves of the respective blocks for the same purposes. The thus erected structure is remarkable by the quality of the joints and by the ease and quickness of its assembly or disassembly.

FINALLY, YET ANOTHER EXAMPLE, U.S. Pat. No. 5,439,749 to Klasell et al. teach a composite wood structure including first and second spaced layers, and a core interposed between the layers. A sheet-like vapor barrier is between the layers and limits migration of moisture through the barrier to less than about 6 grams per square meter of barrier area per hour. The wood structure is thereby made warp-resistant. In another embodiment, the structure has a vapor barrier on an outer surface and may have one or more additional vapor barriers between structure layers. Preferred vapor barrier materials include melamine formaldehyde impregnated paper, phenol formaldehyde impregnated paper, thermoset materials, thermoplastic materials and aluminum foil.

It is apparent that numerous innovations for composite wood structures have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a reconstituted wood block modular building system that avoids the disadvantages of the prior art.

ANOTHER OBJECT of the present invention is to provide a reconstituted wood block modular building system that is simple and inexpensive to manufacture.

STILL ANOTHER OBJECT of the present invention is to provide a reconstituted wood block modular building system that is simple to use.

YET ANOTHER OBJECT of the present invention is to provide a reconstituted wood block modular building system that provides a completely new building concept in the field of home construction that conserves both labor and materials.

STILL YET ANOTHER OBJECT of the present invention is to provide a reconstituted wood block modular building system that protects and conserves the old growth virgin forest from exploitation.

YET STILL ANOTHER OBJECT of the present invention is to provide a reconstituted wood block modular building system that bypasses many of the "stick building" techniques, simplifies construction, conserves finished lumber and other materials, with "do it yourself labor" utilized to a maximum extent.

STILL YET ANOTHER OBJECT of the present invention is to provide a reconstituted wood block modular building system wherein the raw materials for the blocks can be obtained from scrub trees, trees downed by storms, as well as trees that are not suitable for lumber, and from any used scrap lumber that has not been painted and that could be rendered into chips.

YET STILL ANOTHER OBJECT of the present invention is to provide a reconstituted wood block modular building system wherein the density of the block thereof approximates that of a block of soft wood cut from a virgin tree.

STILL YET ANOTHER OBJECT of the present invention is to provide a reconstituted wood block modular building system that does not utilize hardwood blocks made from compressed sawdust since most of the insulation value would be lost.

YET STILL ANOTHER OBJECT of the present invention is to provide a reconstituted wood block modular building system that when utilized to build a home containing approximately 1200 sq. ft. of living area on a simple rectangular concrete slab, with no offshoots, would require approximately 900 exterior blocks for sufficient erection of the exterior walls and 900 interior blocks for sufficient erection of the interior walls.

STILL YET ANOTHER OBJECT of the present invention is to provide a reconstituted wood block modular building system wherein the openings for windows and doors are basically the same as now employed in the construction of "stick built" homes, however, the need for jams, beams, etc. is eliminated, i.e. prebuilt windows and doors are placed into the openings, shimmed, plumbed, and aligned, with the headers therefor formed by drilling two ½" holes horizontally and inserting steel rods therethrough.

YET STILL ANOTHER OBJECT of the present invention is to provide a reconstituted wood block modular building system wherein all of the blocks can be cut with common woodworking tools, such as a small portable band saw with a sliding table.

STILL YET ANOTHER OBJECT of the present invention is to provide a reconstituted wood block modular building system wherein the roof thereof can be placed into position with the use of prebuilt engineered roof trusses and thereby allowing the decking to be a simple operation.

YET STILL ANOTHER OBJECT of the present invention is to provide a reconstituted wood block modular building system that eliminates the need for framing now found in most "stick built" homes which results in a considerable savings in both material and labor.

STILL YET ANOTHER OBJECT of the present invention is to provide a reconstituted wood block modular building system that eliminates the need for sheetrock or paneling, i.e. interior ceilings are constructed by placing 1" by 4" lumber on the bottom cord of the roof trusses, approximately 1' apart, with 8" batt insulation therebetween, and with CELOTEX(TM) tongue and grooved panels stapled thereto.

YET STILL ANOTHER OBJECT of the present invention is to provide a reconstituted wood block modular building system whose inherent insulation value would be cool in the summer and warm in the winter with only a minimum of mechanical central heating and air conditioning equipment.

STILL YET ANOTHER OBJECT of the present invention is to provide a reconstituted wood block modular building system that allows anyone capable of erecting a toy model home from LEGO(TM) building blocks to accomplish the major part of building their own residence with a minimum of instruction.

YET STILL ANOTHER OBJECT of the present invention is to provide a reconstituted wood block modular building system that affords a total cost for a new home 1200 sq. ft. living area constructed therewith, with "do it yourself labor" where possible, and equipped with central heating and air conditioning, to not exceed $38,000, so as to permit low and middle income families to purchase their own homes at affordable costs.

STILL YET ANOTHER OBJECT of the present invention is to provide a reconstituted wood block modular building system whose blocks are much less expensive than a block of solid wood that has been cut and shaped from a virgin tree.

YET STILL ANOTHER OBJECT of the present invention is to provide a reconstituted wood block modular building system that is more durable and flexible than solid wood blocks and thereby eliminates such defects as cracks, splits, and shrinkage.

STILL YET ANOTHER OBJECT of the present invention is to provide a reconstituted wood block modular building system that utilizes almost any variety of soft woods that are converted into wood chips, wood flakes, and wood strands, such as scrub trees, trees downed by storms, trees that have been unusable in the past as a result of their small size and/or configuration, recycled wood scraps from the construction of conventional dwellings, and wood from demolished buildings.

YET STILL ANOTHER OBJECT of the present invention is to provide a reconstituted wood block modular building system whose solid walls are 34% more efficient than "stick built" homes as a result of their thermal mass transmitting heat energy slowly over time.

STILL YET ANOTHER OBJECT of the present invention is to provide a reconstituted wood block modular building system that allows any individual with a primary knowledge of construction to build their own interior and exterior walls of a residence or similar structure with a minimum of capital and professional assistance.

YET STILL ANOTHER OBJECT of the present invention is to provide a reconstituted wood block modular building system whose blocks resemble log, bricks, stucco. Lap siding exterior in appearance.

STILL YET ANOTHER OBJECT of the present invention is to provide a reconstituted wood block modular building system whose blocks can be sawed, cut, drilled, and nailed with common woodworking tools.

YET STILL ANOTHER OBJECT of the present invention is to provide a reconstituted wood block modular building system whose blocks, because of their composition, are self-insulated with a high degree of efficiency.

STILL YET ANOTHER OBJECT of the present invention is to provide a reconstituted wood block modular building system whose blocks are not subject to warpage, cracking, shrinking, or require wood preservatives since their fibrous content has been chemically altered.

YET STILL ANOTHER OBJECT of the present invention is to provide a reconstituted wood block modular building system that eliminates the need for building materials that are normally used in a conventional wood frame structure, such as wood framing, i.e. studs, headers, and blocking, etc., brick siding, nails, wall ties, batt insulation, paneling, and sheetrock, etc.

STILL YET ANOTHER OBJECT of the present invention is to provide a reconstituted wood block modular building system that allows any conventional building products to be added thereto by virtue of the blocks having the ability to be sawed and nailed.

YET STILL ANOTHER OBJECT of the present invention is to provide a reconstituted wood block modular building system that might require some professional assistance to lay the slab therefor and for the electrical and plumbing requirements.

STILL YET ANOTHER OBJECT of the present invention is to provide a reconstituted wood block modular building system that reduces plumbing costs by using plastic pipe, fittings, and drains that have been approved by F.H.A. and V.A.

BRIEFLY STATED, YET STILL ANOTHER OBJECT of the present invention is to provide a reconstituted wood block modular building system utilized to build at least a wall that includes a concrete slab, a plurality of anchor bolts, a plurality of vertically-oriented steel rods, a plurality of threaded sleeves, a plurality of reconstituted wood blocks, a plurality of elongated, slender, and rectangular-parallelepiped-shaped horizontal alignment keys, a plurality of elongated, slender, and rectangular-parallelepiped-shaped vertical alignment keys, and an adhesive. The concrete slab has a perimeter. The plurality of anchor bolts are embedded around the perimeter of the concrete slab and has a threaded upper end. The plurality of vertically-oriented steel rods has threaded ends. The lower end of the threaded ends of each rod of the plurality of vertically-oriented steel rods threadably engages the upper threaded end of a respective anchor bolt of the plurality of anchor bolts. The plurality of threaded sleeves threadably engages the lower end of the threaded ends of each rod of the plurality of vertically-oriented steel rods to the upper threaded end of the respective anchor bolt of the plurality of anchor bolts. The plurality of reconstituted wood blocks are positioned horizontally side by side and are stacked vertically without being staggered. Each block of the plurality of reconstituted wood blocks has a flat top face with a top face longitudinal groove that extends completely horizontally along a longitudinal centerline line thereof. Each block of the plurality of reconstituted wood blocks further has a pair of flat end faces. Each face of the pair of flat end faces has an end face groove that extends completely along a vertical centerline line thereof and communicates with the top face longitudinal groove. Each block of the plurality of reconstituted wood blocks further has a flat bottom face that is below, and parallel to, the flat top face and has a bottom face longitudinal groove that extends completely horizontally along a longitudinal centerline line thereof and communicates with each end face grooves. Each block of the plurality of reconstituted wood blocks further has a flat side face. Each block of the plurality of reconstituted wood blocks further has a cylindrically-shaped throughbore that opens into, and extends vertically downwardly from, a center of the flat top face thereof to, and opens into, a center of the flat bottom face thereof, and communicates with both the top face longitudinal groove and the bottom face longitudinal groove, and provides a conduit for electrical wiring and plumbing and thereby eliminates a need for drilling and cutting. The cylindrically-shaped throughbore in vertically aligned blocks of the plurality of reconstituted wood blocks vertically receives a respective rod of the plurality of vertically-oriented steel rods so as to provide added strength for the wall to withstand most winds and hurricanes. Each key of the plurality of elongated, slender, and rectangular-parallelepiped-shaped horizontal alignment keys is disposed in the end face groove of adjoining end faces of horizontally adjacent blocks of the plurality of reconstituted wood blocks, and functions as a tongue and groove joint while providing horizontal alignment for the horizontally adjacent blocks of the plurality of reconstituted wood blocks. Each key of the plurality of elongated, slender, and rectangular-parallelepiped-shaped vertical alignment keys is disposed in the top face longitudinal groove in each block of the plurality of reconstituted wood blocks, on both sides of the cylindrically-shaped throughbore, and extends horizontally into the top face longitudinal groove in a horizontally adjacent block of the plurality of reconstituted wood blocks. Each key of the plurality of elongated, slender, and rectangular-parallelepiped-shaped vertical alignment keys is further disposed in the bottom face longitudinal groove in a vertically adjacent block of the plurality of reconstituted wood blocks, on both sides of the cylindrically-shaped throughbore, and extends horizontally into the bottom face longitudinal groove in a horizontally adjacent block of the plurality of reconstituted wood blocks, and functions as a tongue and groove joint while providing vertical alignment for vertically adjacent blocks of the plurality of reconstituted wood blocks. And, the adhesive is disposed on, and attaches, adjoining faces of adjacent blocks of the plurality of blocks, without the need for mortar.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 6 is an exploded perspective view of a portion of the exterior wall of FIG. 1, illustrating the cooperation of parts thereof; and FIG. 7 is a diagrammatic partial cutaway side elevational view of the exterior wall of FIG. 1 completed and supporting a roof assembly thereon.

LIST OF REFERENCE NUMERALS UTILIZED IN THE DRAWING

Figure 1:
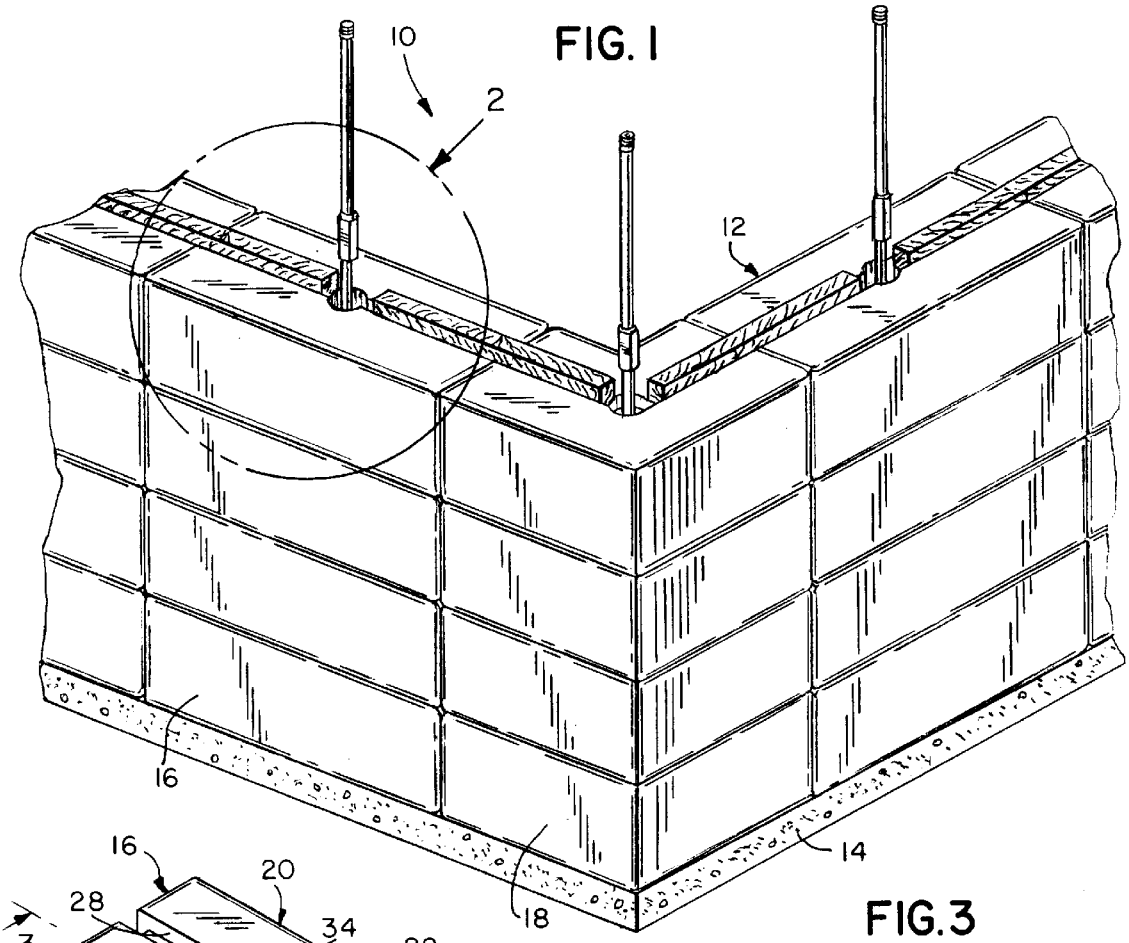
FIG. 1 is a diagrammatic fragmentary perspective view of the present invention utilized to build an exterior wall having a corner.

10 reconstituted wood block modular building system of the present invention
12 wall
14 concrete slab
16 plurality of exterior blocks
18 plurality of corner blocks
20 exterior block rectangular-parallelepiped-shaped block
22 exterior block flat and rectangular-shaped top face
24 exterior block flat and rectangular-shaped bottom face
26 exterior block pair of flat, parallel, and opposing end faces
27 exterior block flat and rectangular-shaped side face
28 the exterior block top face longitudinal groove
30 exterior block end face groove
32 exterior block bottom face longitudinal groove
34 exterior block cylindrically-shaped throughbore
36 exterior block side face rectangular-shaped and vertically-oriented bore
38 interior block rectangular-parallelepiped-shaped block
40 plurality of elongated, slender, and rectangular-parallelepiped-shaped horizontal alignment keys
42 plurality of elongated, slender, and rectangular-parallelepiped-shaped vertical alignment keys
44 plurality of anchor bolts
46 plurality of steel rods
48 threaded sleeves
50 top plate
52 washer
54 nut
56 roof trusses

DETAILED DESCRIPTION OF THE PREFERRED EMBODIMENT

Referring now to the figures in which like numerals indicate like parts and particularly to FIG. 1, which is a diagrammatic fragmentary perspective view of the present invention utilized to build an exterior wall having a corner, the reconstituted wood block modular building system of the present invention is shown generally at 10 utilized to build a wall 12 with a top on a concrete slab 14 with a perimeter by utilization of a plurality of exterior blocks 16 and a plurality of corner blocks 18 which are stacked and not staggered as would be required for brick or concrete blocks.

The configuration of a typical exterior block of the plurality of exterior blocks 16 can best be seen in FIGS. 2 and 3, which are a diagrammatic perspective view of a typical exterior block generally enclosed by the dotted ellipse identified by arrow 2 in FIG. 1, and a cross sectional view taken on line 3—3 in FIG. 2, respectively, and as such will be discussed with reference thereto.

The typical block of the plurality of exterior blocks 16 is an exterior block rectangular-parallelepiped-shaped block 20 that has an exterior block flat and rectangular-shaped top face 22, an exterior block flat and rectangular-shaped bottom face 24 that is below, and parallel to, the exterior block flat and rectangular-shaped top face 22 of the exterior block rectangular-parallelepiped-shaped block 20, an exterior block pair of flat, parallel, and opposing end faces 26, and exterior block flat and rectangular-shaped side face 27.

The exterior block rectangular-parallelepiped-shaped block 20 is preferably 8" wide, 6" high, 18" long, and weights approximately 22 lbs.

The exterior block flat and rectangular-shaped top face 22 of the exterior block rectangular-parallelepiped-shaped block 20 has an exterior block top face longitudinal groove 28 that extends completely horizontally along a longitudinal centerline line thereof, and which is preferably 1" wide and ½" deep.

Each face of the exterior block pair of flat, parallel, and opposing end faces 26 of the exterior block rectangular-parallelepiped-shaped block 20 has an exterior block end face groove 30 that extends completely along a vertical centerline line thereof, and communicates with the exterior block top face longitudinal groove 28 in the exterior block flat and rectangular-shaped top face 22 of the exterior block rectangular-parallelepiped-shaped block 20, and which is preferably 1" wide and ½" deep.

The exterior block flat and rectangular-shaped bottom face 24 of the exterior block rectangular-parallelepiped-shaped block 20 has an exterior block bottom face longitudinal groove 32 that extends completely horizontally along a longitudinal centerline line thereof, and communicates with the exterior block end face groove 30 in each face of the exterior block pair of flat, parallel, and opposing end faces 26 of the exterior block rectangular-parallelepiped-shaped block 20, and which is preferably 1" wide and ½" deep.

It is apparent that the exterior block top face longitudinal groove 28 in the exterior block flat and rectangular-shaped top face 22 of the exterior block rectangular-parallelepiped-shaped block 20, the exterior block end face groove 30 in each face of the exterior block pair of flat, parallel, and opposing end faces 26 of the exterior block rectangular-parallelepiped-shaped block 20, and the exterior block bottom face longitudinal groove 32 in the exterior block flat and rectangular-shaped bottom face 24 of the exterior block rectangular-parallelepiped-shaped block 20 together form a continuous groove that extends longitudinally around the exterior block rectangular-parallelepiped-shaped block 20.

The exterior block rectangular-parallelepiped-shaped block 20 further has an exterior block cylindrically-shaped throughbore 34 that opens into, and extends vertically downwardly from a center of the exterior block flat and rectangular-shaped top face 22 of the exterior block rectangular-parallelepiped-shaped block 20 to, and opening into, a center of the exterior block flat and rectangular-shaped bottom face 24 of the exterior block rectangular-parallelepiped-shaped block 20, while communicating with both the exterior block top face longitudinal groove 28 in the exterior block flat and rectangular-shaped top face 22 of the exterior block rectangular-parallelepiped-shaped block 20 and the exterior block bottom face longitudinal groove 32 in the exterior block flat and rectangular-shaped bottom face 24 of the exterior block rectangular-parallelepiped-shaped block 20.

The exterior block cylindrically-shaped throughbore 34 in the exterior block rectangular-parallelepiped-shaped block 20 provides a conduit for electrical wiring and plumbing, eliminating the need for drilling and cutting, and is preferably 2" dia.

The exterior block rectangular-parallelepiped-shaped block 20 preferably has ¼" rounded edges to prevent chipping when handled and to provide a grout line for construction adhesive.

The exterior block rectangular-parallelepiped-shaped block 20 comprises wood residue which either wood chips, wood scraps, wood strands, or combinations thereof that are bonded together by a bonding agent which is preferably phenol formaldehyde.

The method of making the exterior block rectangular-parallelepiped-shaped block 20 will be discussed, infra.

STEP 1: Add a predetermined amount of wood residue to a receptacle wherein the wood residue is preferably either wood chips, wood scraps, wood strands, or combinations thereof and the receptacle is either a bin or an impeller type mixer.

STEP 2: Add a predetermined amount of a bonding agent to the wood residue in the receptacle to form a first composition wherein the bonding agent is preferably approximately 3 lbs. of phenol formaldehyde which is a phenolic polymer resin sold by Neste Resins Corp. for approximately 18 cents a pound, and which contains no urea formaldehyde and therefore is exempt from all provisions of the HUD Safety Standards which refer to formaldehyde.

STEP 3: Add a predetermined amount of wax, for increased mold release characteristics, to the first composition in the receptacle to form a second composition.

STEP 4: Mix the second composition thoroughly to form a mixed composition with a density.

STEP 5: Monitor the density of the mixed composition carefully as it is being mixed and form a properly mixed composition.

STEP 6: Place the properly mixed composition into a properly shaped steel mold.

STEP 7: Apply heat and pressure for a specific period of time to cure and bond the properly mixed composition to form the exterior block rectangular-parallelepiped-shaped block 20 wherein the heat can be microwave energy.

STEP 8: Eject the exterior block rectangular-parallelepiped-shaped block 20.

Figure 2:
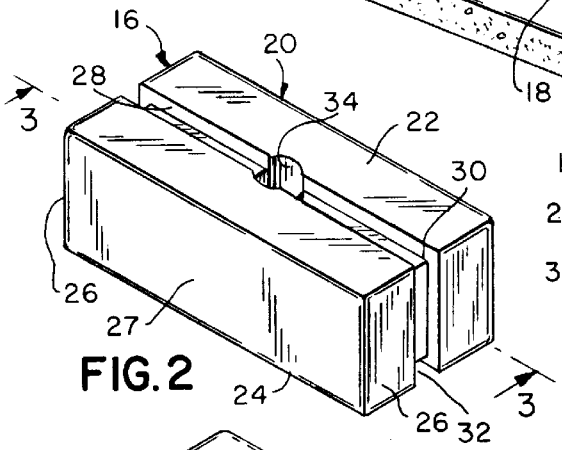
FIG. 2 is a diagrammatic perspective view of a typical exterior block generally enclosed by the dotted ellipse identified by arrow 2 in FIG. 1.
Figure 3:
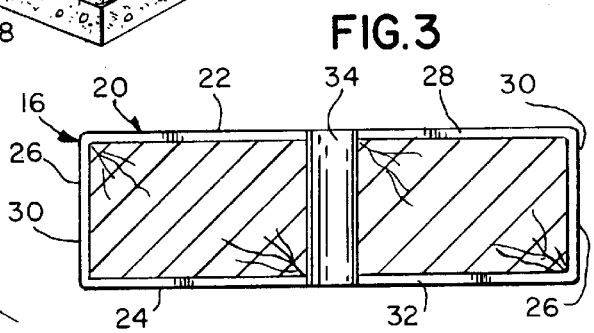
FIG. 3 is a cross sectional view taken on line 3—3 in FIG. 2.
Figure 4:
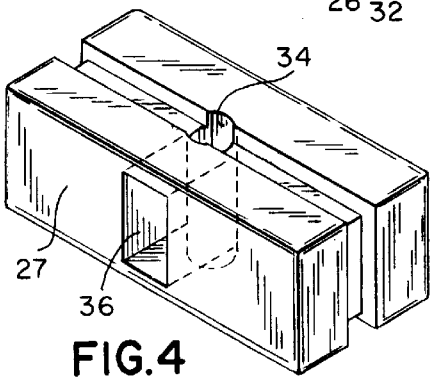
FIG. 4 is a diagrammatic perspective view of the typical exterior block of FIG. 2, but with a rectangular bore therein for mounting an electrical outlet utility box.

As shown in FIG. 4, which is a diagrammatic perspective view of the typical exterior block of FIG. 2, but with a rectangular bore therein for mounting an electrical outlet utility box, the exterior block rectangular-parallelepiped-shaped block 20 of the exterior block flat and rectangular-shaped side face 27 has an exterior block side face rectangular-shaped and vertically-oriented bore 36 that extends vertically at a center thereof, and communicates with the exterior block cylindrically-shaped throughbore 34 of the exterior block rectangular-parallelepiped-shaped block 20, and accommodates an electrical outlet utility box, if required.

The exterior block side face rectangular-shaped and vertically-oriented bore 36 in the exterior block flat and rectangular-shaped side face 27 of the exterior block rectangular-parallelepiped-shaped block 20 is preferably 2" wide and 3" high.

Figure 5:
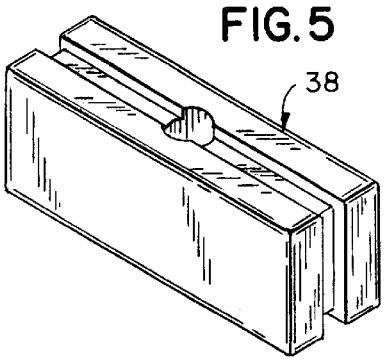
FIG. 5 is a diagrammatic perspective view of a typical interior block similar to the typical exterior block of FIG. 2, but narrower.

As shown in FIG. 5, which is a diagrammatic perspective view of a typical interior block similar to the typical exterior block of FIG. 2, but narrower, an interior block rectangular-parallelepiped-shaped block 38 is provided which is identical to the exterior block rectangular-parallelepiped-shaped block 20, except narrower and preferably 4" wide and weighing approximately 11 lbs.

As shown in FIG. 1, the corner block 18 is similar to the exterior block rectangular-parallelepiped-shaped block 20, but is formed to produce at a 90 degree angle, measuring 12" in length on each side thereof, and which can be flipped over to form either a right angle or a left angle, depending upon need. Likewise, the exterior block rectangular-parallelepiped-shaped block 20 with the exterior block side face rectangular-shaped and vertically-oriented bore 36 in the exterior block flat and rectangular-shaped side face 27 thereof can also be flipped over depending upon which side the electrical outlet utility box is required.

As shown in FIG. 6, which is an exploded perspective view of a portion of the exterior wall of FIG. 1, illustrating the cooperation of parts thereof, the reconstituted wood block modular building system 10 further includes a plurality of elongated, slender, and rectangular-parallelepiped-shaped horizontal alignment keys 40, each of which is disposed in the exterior block end face groove 30 of adjoining faces of the exterior block pair of flat, parallel, and opposing end faces 26 of horizontally adjacent exterior block rectangular-parallelepiped-shaped blocks 20, and functions as a tongue and groove joint and provides horizontal alignment when required.

Each key of the plurality of elongated, slender, and rectangular-parallelepiped-shaped horizontal alignment keys 40 is preferably a piece of either lumber or manufactured wood that is 1" wide, 1" high, and 6" long, and is not molded as an integral part of the exterior block rectangular-parallelepiped-shaped block 20 when manufactured, as many of the blocks such as those that encompass door and window units do not require such a joint.

The reconstituted wood block modular building system 10 further includes a plurality of elongated, slender, and rectangular-parallelepiped-shaped vertical alignment keys 42.

Each key of the plurality of elongated, slender, and rectangular-parallelepiped-shaped vertical alignment keys 42 is disposed in the exterior block top face longitudinal groove 28 in the exterior block flat and rectangular-shaped top face 22 of each exterior block rectangular-parallelepiped-shaped block 20, on both sides of the exterior block cylindrically-shaped throughbore 34, and extends horizontally into the exterior block top face longitudinal groove 28 in the exterior block flat and rectangular-shaped top face 22 in a horizontally adjacent exterior block rectangular-parallelepiped-shaped block 20.

The each key of the plurality of elongated, slender, and rectangular-parallelepiped-shaped vertical alignment keys 42 is further disposed in the exterior block bottom face longitudinal groove 32 in the exterior block flat and rectangular-shaped bottom face 24 of a vertically adjacent exterior block rectangular-parallelepiped-shaped block 20, on both sides of the exterior block cylindrically-shaped throughbore 34, and extends horizontally into the exterior block bottom face longitudinal groove 32 in the exterior block flat and rectangular-shaped bottom face 24 of a horizontally adjacent exterior block rectangular-parallelepiped-shaped block 20, and functions as a tongue and groove joint while providing vertical alignment for vertically adjacent blocks of the plurality of blocks.

Each key of the plurality of elongated, slender, and rectangular-parallelepiped-shaped vertical alignment keys 42 is preferably a piece of either lumber or manufactured wood that is 1" wide, 1" high, and 1' long, and is not molded as an integral part of the exterior block rectangular-parallelepiped-shaped block 20 when manufactured, as many of the blocks such as those that encompass door and window units do not require such a joint.

The reconstituted wood block modular building system 10 further includes a plurality of anchor bolts 44 that are embedded around the perimeter of the concrete slab 14, preferably approximately 6 to 8 feet apart.

The reconstituted wood block modular building system 10 further includes a plurality of steel rods 46, each of which being having threaded ends and being preferably ⅜" dia. and 2' long since longer lengths or a single rod would be unwieldy by interfering with placing the blocks.

Each rod of the plurality of steel rods 46 is coupled to a respective anchor bolt of the plurality of anchor bolts 44, by a threaded sleeves 48, and passes vertically upwardly through the exterior block cylindrically-shaped throughbore 34 in vertically aligned exterior block rectangular-parallelepiped-shaped blocks 20 so as to provide added strength for the wall 12 to withstand most winds and hurricanes.

If required, which usually is the case, additional rods of the plurality of steel rods 46 can be added to subsequent rods of the plurality of steel rods 46, by use of the threaded sleeves 48, as the wall 12 progresses, so as to extend their length to the top of the wall 12.

The plurality of stacked exterior blocks 16 and the plurality of stacked corner blocks 18 are glued together with a waterproof type of construction adhesive, which is preferably the type of adhesive presently being used to bond parquet floors to a concrete slab, without the need for mortar.

As a result of the rounded edges of the exterior block rectangular-parallelepiped-shaped block 20, the adhesive would form a grout line that provides a finished look for the wall 12.

As shown in FIG. 7, which is a diagrammatic partial cutaway side elevational view of the exterior wall of FIG. 1 completed and supporting a roof assembly thereon, a top plate 50, which preferably is either lumber or reconstituted wood, sits on the top course of the blocks, with the plurality of steel rods 46 extending through apertures therein and being tied down with a washer 52 and a nut 54 so as to provide extra protection from high winds, while the top plate 50 also serves as a base for roof trusses 56.

It will be understood that each of the elements described above, or two or more together, may also find a useful application in other types of constructions differing from the types described above.

While the invention has been illustrated and described as embodied in a reconstituted wood block modular building system, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A reconstituted wood block modular building system utilized to build at least a wall, comprising:

a) a concrete slab having a perimeter;

b) a plurality of anchor bolts embedded around said perimeter of said concrete slab and having a threaded upper end;

c) a plurality of vertically-oriented steel rods having threaded ends; a lower end of said threaded ends of each rod of said plurality of vertically-oriented steel rods engaging said upper threaded end of a respective anchor bolt of said plurality of anchor bolts;

d) a plurality of threaded sleeves threadably engaging said lower end of said threaded ends of said each rod of said plurality of vertically-oriented steel rods to said upper threaded end of said respective anchor bolt of said plurality of anchor bolts;

e) a plurality of reconstituted wood blocks being positioned horizontally side by side and being stacked vertically without being staggered; each block of said plurality of reconstituted wood blocks having a flat top face with a top face longitudinal groove extending completely horizontally along a longitudinal centerline line thereof; each block of said plurality of reconstituted wood blocks further having a pair of flat end faces; each face of said pair of flat end faces having an end face groove extending completely along a vertical centerline line thereof and communicating with said top face longitudinal groove; each block of said plurality of reconstituted wood blocks further having a flat bottom face being below, and parallel to, said flat top face and having a bottom face longitudinal groove extending completely horizontally along a longitudinal centerline line thereof and communicating with each said end face grooves; each block of said plurality of reconstituted wood blocks further having a flat side face; each block further having a cylindrically-shaped throughbore opening into, and extending vertically downwardly from, a center of said flat top face thereof to, and opening into, a center of said flat bottom face thereof, and communicating with both said top face longitudinal groove and said bottom face longitudinal groove, and providing a conduit for electrical wiring and plumbing and thereby eliminating a need for drilling and cutting; said cylindrically-shaped throughbore in vertically aligned blocks of said plurality of reconstituted wood blocks vertically receiving a respective rod of said plurality of vertically-oriented steel rods so as to provide added strength for the wall to withstand most winds and hurricanes; each block of said plurality of reconstituted wood blocks comprising wood residue being at least one of wood chips, wood scraps and wood strands being bonded together by a bonding agent being phenol formaldehyde; at least one block of said plurality of reconstituted wood blocks being a reconstituted wood 90 degree corner block, and being 12" long on each side thereof;

f) a plurality of elongated, slender, and rectangular-parallelepiped-shaped horizontal alignment keys, each of which being disposed in said end face groove of adjoining end faces of horizontally adjacent blocks of said plurality of reconstituted wood blocks, and functioning as a tongue and groove joint while providing horizontal alignment for said horizontally adjacent blocks of said plurality of reconstituted wood blocks;

g) a plurality of elongated, slender, and rectangular-parallelepiped-shaped vertical alignment keys; each key of said plurality of elongated, slender, and rectangular-parallelepiped-shaped vertical alignment keys being disposed in said top face longitudinal groove in each block of said plurality of reconstituted wood blocks, on both sides of said cylindrically-shaped throughbore, and extending horizontally into said top face longitudinal groove in a horizontally adjacent block of said plurality of reconstituted wood blocks and functioning as a tongue and groove joint; said each key of said plurality of elongated, slender, and rectangular-parallelepiped-shaped vertical alignment keys being further disposed in said bottom face longitudinal groove in a vertically adjacent block of said plurality of reconstituted wood blocks, on both sides of said cylindrically-shaped throughbore, and extending horizontally into said bottom face longitudinal groove in a horizontally adjacent block of said plurality of reconstituted wood blocks, and functioning as a tongue and groove joint while providing vertical alignment for vertically adjacent blocks of said plurality of reconstituted wood blocks;

h) an adhesive disposed on, and attaching, adjoining faces of adjacent blocks of said plurality of blocks, without the need for mortar; and i) a top plate being one of lumber and reconstituted wood and sitting on a top course of said plurality of blocks, with said plurality of steel rods extending through apertures therein and being tied down with a washer and a nut so as to provide extra protection from high winds, with said top plate also serving as a base for roof trusses.

2. The system as defined in claim 1, wherein said plurality of anchor bolts are 6' to 8' apart.

3. The system as defined in claim 1, wherein said top face longitudinal groove is 1" wide and ½" deep.

4. The system as defined in claim 1, wherein each said end face groove is 1" wide and ½" deep.

5. The system as defined in claim 1, wherein said bottom face longitudinal groove is 1" wide and ½" deep.

6. The system as defined in claim 1, wherein each block of said plurality of reconstituted wood blocks has ¼" rounded corners to prevent chipping when handled and to provide a grout line for construction adhesive.

7. The system as defined in claim 1, wherein said flat side face of at least one block of said plurality of reconstituted wood blocks has a 2" by 3" rectangular-shaped and vertically-oriented bore that extends vertically at a center thereof, and communicates with said cylindrically-shaped throughbore, and accommodates an electrical outlet utility box.

8. The system as defined in claim 1, wherein each key of said plurality of elongated, slender, and rectangular-parallelepiped-shaped horizontal alignment keys is a piece of at least one of lumber, manufactured wood, and combinations thereof, is 1" wide, 1" high, and 6" long, and is not molded as an integral part of any block of said plurality of reconstituted wood blocks.

9. The system as defined in claim 1, wherein each key of said plurality of elongated, slender, and rectangular-parallelepiped-shaped vertical alignment keys is a piece of at least one of lumber and manufactured wood, is 1" wide, 1" high, and 1' long, and is not molded as an integral part of any block of said plurality of reconstituted wood blocks.

10. The system as defined in claim 1, wherein each rod of said plurality of steel rods is ⅜" dia. and 2' long.

11. The system as defined in 1, wherein each rod of said plurality of steel rods is more than one rod coupled together by said plurality of threaded sleeves as the wall progresses.

12. The system as defined in claim 1, wherein said adhesive is a waterproof type of construction adhesive.

13. The system as defined in claim 1, wherein at least one block of said plurality of reconstituted wood blocks is a rectangular-parallelepiped-shaped exterior reconstituted wood block.

14. The system as defined in claim 13, wherein said rectangular-parallelepiped-shaped exterior block is 8" wide, 6" high, 18" long, and weights approximately 22 lbs.

15. The system as defined in claim 1, wherein said cylindrically-shaped throughbore in each block of said plurality of reconstituted wood blocks is 2" dia.

16. The system as defined in claim 1, wherein at least one block of said plurality of reconstituted wood blocks is a rectangular-parallelepiped-shaped reconstituted wood interior block.

17. The system as defined in claim 16, wherein said rectangular-parallelepiped-shaped reconstituted wood interior block is 4" wide, 6" high, 18" long, and weights approximately 11 lbs.

* * * * *